US006779423B2

(12) United States Patent
Hammons et al.

(10) Patent No.: US 6,779,423 B2
(45) Date of Patent: Aug. 24, 2004

(54) KICKOFF SOCKET

(75) Inventors: Gary Hammons, Richwood, OH (US); Russell Gygi, Columbus, OH (US); James Gatchel, Morral, OH (US); Robert Bogard, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 34 days.

(21) Appl. No.: 10/193,937

(22) Filed: Jul. 12, 2002

(65) Prior Publication Data

US 2004/0007100 A1 Jan. 15, 2004

(51) Int. Cl.[7] ..... B25B 13/02
(52) U.S. Cl. ..... 81/125; 81/121.1
(58) Field of Search ..... 81/121.1, 124.6, 81/125, 180.1

(56) References Cited

U.S. PATENT DOCUMENTS

| | | | | | |
|---|---|---|---|---|---|
| 1,651,361 | A | | 12/1927 | Ayotte | |
| 2,961,905 | A | * | 11/1960 | Stumpf | 81/124.6 |
| 3,604,106 | A | | 9/1971 | Borries | |
| 3,789,706 | A | * | 2/1974 | Smith | 81/125 |
| 3,878,740 | A | | 4/1975 | Gutshall | |
| 4,919,020 | A | * | 4/1990 | Huebschen | 81/125 |
| 5,163,345 | A | * | 11/1992 | Doan et al. | 81/125 |
| 5,199,334 | A | * | 4/1993 | Vasichek et al. | 81/125 |
| 5,277,088 | A | * | 1/1994 | Vasichek et al. | 81/125 |
| 5,542,320 | A | * | 8/1996 | Vasichek et al. | 81/125 |
| 5,564,614 | A | | 10/1996 | Yang | |
| 5,924,369 | A | | 7/1999 | Hatcher | |
| 6,170,365 | B1 | | 1/2001 | Zerver | |
| 2003/0041698 | A1 | * | 3/2003 | Chi | 81/125 |

* cited by examiner

*Primary Examiner*—James G. Smith
(74) *Attorney, Agent, or Firm*—Rankin, Hill, Porter & Clark LLP; Alan T. McDonald; Vincent Ciamacco

(57) ABSTRACT

A kickoff socket assembly includes a socket and an insert member that fits closely inside the socket. The insert member includes a body portion and a projection. The projection integrally extends from the body portion, and has a distal end disposed a predetermined distance from the open end of the socket, and is narrower in diameter than the body portion of the insert member. In use, a nut is placed over the projection such that the projection extends partially through the nut. The nut is engaged with a threaded shaft and the socket is rotated to drive the nut onto the shaft. Rotation of the nut is stopped by engagement of the distal end of the projection with the shaft when the nut is threaded the predetermined distance on the shaft.

13 Claims, 1 Drawing Sheet

KICKOFF SOCKET

FIELD OF THE INVENTION

The present invention generally relates to a socket wrench and, more particularly, toward a socket wrench assembly that accurately threads a nut a predetermined amount or distance on a threaded shaft.

DESCRIPTION OF RELATED ART

Devices for positioning a nut a predetermined depth on a threaded shaft or bolt are known in the art. One known device utilizes a spring to place a nut at a particular depth on a threaded shaft. This prior art device includes a commercially available socket, a pin, and a spring. The socket is cylindrical in shape, with an inner and outer diameter, is open at the top end, and is substantially closed at the bottom end. The socket has a longitudinal axis, with a length extending from the bottom to the top of the socket.

The pin is cylindrical in shape, with a smaller diameter than the inside diameter of the socket and a distal end disposed beneath the open end of the socket. The spring is wrapped around the pin, so that the pin fits inside the spring. The spring has a common longitudinal axis with the socket and the pin, so that it extends from the bottom of the socket toward the top of the socket. The length of the spring is shorter than the length of the pin.

The pin fits inside the center of a nut, and extends partially through the nut. The nut is registered in the open end of the socket and rests on the top of the spring, so that the spring keeps the nut from falling toward the bottom of the socket. The nut is turned onto the threaded shaft by rotation of the socket, with the depth or amount the nut is threaded onto the shaft being limited by engagement of the pin's distal end with the end of the shaft.

Another prior art device, shown in FIG. 1, includes a socket 10, a brass sleeve 12 and a pin 14. The socket 10 is similar to the socket described above, and the pin 14 is also similar to the pin described above. However, in this design the brass sleeve 12 is used instead of a spring. The brass sleeve 12 is cylindrical, with a longitudinal axis that is common with the longitudinal axis of the pin 14 and the socket 10. An inner diameter of the sleeve 12 is slightly larger than the outer diameter of the pin 14, so that the pin can be inserted into the sleeve 12. The brass sleeve 12 has an outer surface that is shaped to be closely received in the socket 10, so that the sleeve has an interference fit inside the socket. The brass sleeve 12 has a length that extends from the bottom of the socket 10 toward the top of the socket, and is shorter than the length of the pin 14. When the pin is positioned inside a portion of a nut, the nut rests on the top of the brass sleeve. The sleeve prevents the nut from falling to the bottom of the socket.

Unfortunately, the prior art devices suffer from disadvantages that limit their effectiveness in production or manufacturing applications. For example, in the spring loaded device, the spring wears out over time, which makes initial threaded engagement of the nut with the bolt problematic. Therefore, the spring-biased device requires periodic replacement of the spring.

In the other prior art device illustrated in FIG. 1, the brass sleeve gradually wears, which also eventually presents problems in registering the nut on the threaded shaft. More specifically, when the brass sleeve wears, the pin extends farther through the nut and causes the shaft to engage the pin before the nut is threaded on the shaft the desired predetermined distance. In extreme cases, the pin will extend so far through the nut that the nut cannot be threaded onto the shaft. Also, the pin is not positively held in place and, due to the challenging environment presented in manufacturing situations, is moved longitudinally within the sleeve. Such movement also causes premature engagement between the pin and shaft, and thus causes the nut to be imprecisely threaded onto the shaft. In extreme cases, this movement of the pin prevents the nut from threadably engaging the shaft. It has been found that, in manufacturing situations, repair or replacement of the aforementioned nut positioning tool must be performed about every two weeks in order to maintain acceptable quality. As can be appreciated, this frequency of replacement is undesirable for a basic manufacturing tool.

Therefore, there is a need in the art for a device that precisely and reliably positions a nut on a threaded shaft. Moreover, there exists a need in the art for a device that is durable and can be used for extended periods of time without repair or replacement.

SUMMARY OF INVENTION

The present invention is directed toward a device and method for precisely and reliably positioning a nut on a threaded shaft. The present invention provides an assembly including a socket and an insert member. The insert member is cylindrical, has a longitudinal axis common to the socket, and extends from the bottom of the socket toward the top of the socket. The insert member has a body portion with an outer surface that corresponds to an inner surface of the socket, so that the insert member has an interference fit with the socket and rotates with the socket. The one-piece insert shows improved wear and can be used for extended periods of time without repair or replacement. Moreover, the one-piece insert provides for more accurate nut placement on a threaded shaft because the top of the insert member, which includes a surface adapted to support the nut and a surface that serves to engage the shaft upon which the nut is threaded, is maintained at a constant distance from the top of the socket.

BRIEF DESCRIPTION OF THE DRAWINGS

These and further features of the invention will be apparent with reference to the following description and drawings, wherein.

DETAILED DESCRIPTION OF PREFERRED EMBODIMENTS

Figure 1:
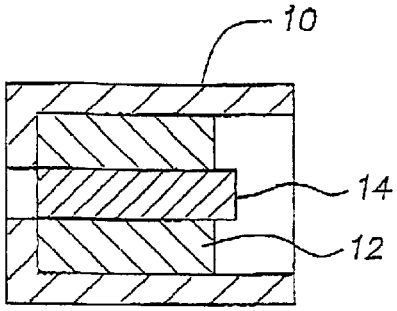
FIG. 1 PRIOR ART
FIG. 1 is a cross section of the prior art socket and insert.
Figure 2:
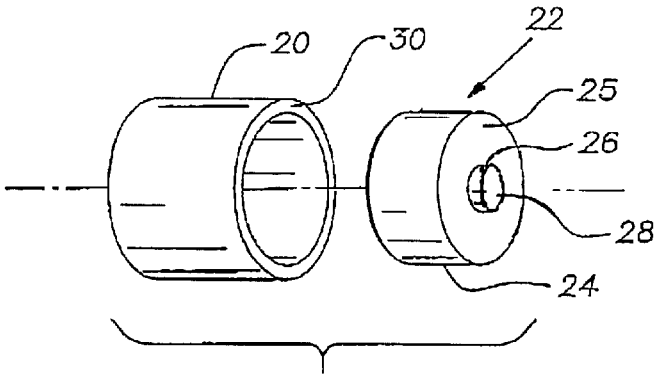
FIG. 2 is an exploded perspective of a socket and an insert member of the present invention.
Figure 3:
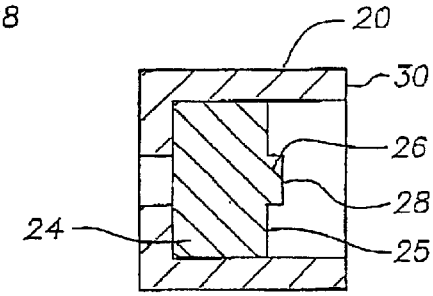
FIG. 3 is an assembled cross-section of the socket and insert member of the present invention; and, FIG. 4 is an elevational view, in partial cross-section, showing the socket and insert member holding a nut that has been threaded onto a threaded shaft.

With reference to the drawings, a kickoff socket assembly according to the invention is shown to include a socket 20 and an insert member 22. The socket 20 is conventional in shape, is open at a top or distal end, and has a bottom or proximal end that has a conventional square opening to receive a driver, such as an air-driven wrench or the like. The socket 20 defines a longitudinal axis, a length extending from the bottom to the top of the socket, and an inner diameter. The socket is preferably a readily commercially available item, so as to be easily replaced, and is sized to receive a nut to be installed on a bolt or threaded shaft, described hereinafter. Although the inner surface of the socket 20 is shown to be circular, it will be appreciated that the surface is polygonally shaped (i.e., hexagonal) so as to drivingly or rotatably engage a nut or the like.

The insert member 22 has a body portion 24 and a projection 26. When placed in the socket 20, the insert member 22 has a common longitudinal axis with the socket. Accordingly, when the insert member is received in the socket the axes of the insert member 22 and socket 20 are aligned. The body portion 24 has an outer surface that corresponds to the inner surface of the socket (i.e., hexagonal shape), so that the body portion 24 and the socket 20 have an interference fit and are linked for common or mutual rotation about their common axis. The body portion 24 has a length dimension extending from the bottom of the socket 20 toward the top of the socket, and is shorter than the length of the socket, as illustrated. The distal end or face 25 of the body member is annular and faces toward the open end of the socket 20.

The projection 26 is cylindrical and has a proximal end integrally extending from the top of the body portion 24 in alignment with the body portion axis. A distal end 28 of the projection 26 is preferably disposed at a distance of 3–4 mm from the top or open end 30 of the socket 20. The projection 26, which has a shorter length than the body portion 24 and a smaller diameter than the body portion 24, is adapted to extend part-way through a nut 32, as will be described more fully hereinafter.

Figure 4:
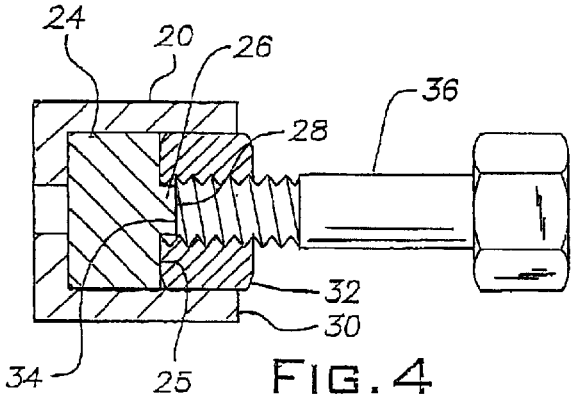

With reference to FIG. 4, the kickoff socket assembly of the present invention is shown in use, and, more specifically, is illustrated at the moment in which the projection distal end 28 has engaged a proximal end 34 of a threaded shaft 36, and thereby position the nut 32 a predetermined amount or distance onto the threaded proximal end 34 of the threaded member 36. The nut 32 is conventionally shaped, having a longitudinal axis extending from bottom to top, a polygonal exterior, and a cylindrical threaded inner surface.

The projection 28 is sized so that it fits inside the nut 32, which allows for placement of the nut on the insert member 22. The projection 28 extends partway through the nut 32, and the nut rests on the annular distal end or face 25 of the insert body portion 22 while being surrounded by the socket. Accordingly, the nut 32 is positively received by the kickoff socket assembly and is prevented from falling down toward the bottom of the socket 20.

As noted, the projection 28 extends partially through the center of the nut 32, which allows the bolt or threaded member 34 to enter the nut 32 from the opposite end while the nut 32 rests against the distal surface 25 of the body portion 22. With the nut 32 so received by the kickoff socket assembly, the nut 32 is moved into engagement with the threaded rod 34. Subsequent rotation of the socket assembly rotates the nut and threads the nut 32 onto the shaft member 34 until the distal end 28 of the projection 26 engages the shaft proximal end 34. The spacing between the distal end of the projection 26 and the open end of the socket, noted hereinbefore, is specifically chosen so that, when the projection engages the shaft, the nut 32 is threaded onto the shaft 36 the predetermined desired amount or length. Depending upon the thickness of the nut 32, the predetermined distance that the nut 32 is threaded onto the shaft 36 may be greater than, equal to, or less than the distance between the projection distal end 28 and the socket open end 30.

Accordingly, the kickoff socket assembly of the present invention is adapted to thread the nut 32 a predetermined amount or distance onto the threaded shaft 36, as is desirable for preliminary placement in manufacturing processes. The insert member 22 is preferably formed from steel as a unitary or one-piece assembly. The insert may be inexpensively formed by simple machining operations, such as EDM machining, progressive stamping, and/or grinding. The distal surfaces of the insert member, namely the distal end of the projection and the distal face of the insert body member, may be hardened by conventional techniques to improve the wear-resistance of the insert member, if desired.

The kickoff socket assembly according to the present invention has been found to be reliable and durable. In fact, the kickoff socket assembly can be used for several months, i.e. 6–7 months, without maintenance or repair, while reliably threading the nut a predetermined amount on the shaft. Accordingly, the kickoff socket assembly according to the present invention is a significant improvement over the state of the art, in terms of quality, cost, and maintenance expense.

Additional advantages and modifications will readily occur to those skilled in the art. Therefore, the invention in its broader aspects is not limited to the specific details and illustrative examples shown and described herein. Accordingly, various modifications may be made without departing from the spirit and scope of the invention as defined by the appended claims and their equivalents.

What is claimed:

1. A method of installing a nut on a threaded shaft comprising:

providing a socket assembly comprising a socket and an insert member, said insert member being received within said socket and linked with said socket for common rotation therewith, said insert member including a body portion and a projection, said projection extending axially from said body portion and toward an open end of said socket, said projection including a distal end that is spaced a first predetermined distance from said socket open end;

placing the nut in the socket such that the nut rests on the insert member inside the socket and the projection extends only partially through the nut;

moving said socket with the nut into position relative to a threaded shaft such that the threaded shaft is inserted into an open end of said nut;

rotating said socket to thread said nut onto said shaft; and, engaging said projection distal end with an end surface of said threaded shaft and thereby preventing further rotation of said nut relative to said threaded shaft when said nut is threaded a second predetermined distance on said shaft.

2. The method according to claim 1, wherein said first predetermined distance is equal to said second predetermined distance.

3. The method according to claim 1, wherein the first predetermined distance is greater than the second predetermined distance.

4. The method according to claim 1, wherein the first predetermined distance is less than the second redetermined distance.

5. The meth according to claim 1, wherein the first predetermined distance is between about 3–4 mm.

6. The method of claim 1, wherein the socket assembly is provided such that the insert member has a common longitudinal axis with the socket.

7. The method according to claim 6, wherein the step of providing a socket assembly comprises the steps of:

providing the socket;

providing the insert member; and inserting the insert member into the socket.

8. The method of claim 7, wherein the insert member is inserted into the socket so as to have an interference fit with the socket.

9. The method of claim 8, wherein the socket and the insert member are provided such that the insert member has an outer surface that corresponds to an inner surface of the socket.

10. The method of claim 9, wherein the socket and the insert member are provided such that the inner surface of the socket and the outer surface of the insert member are both polygonally shaped.

11. The method of claim 7, wherein the insert member is provided in one piece.

12. The method of claim 11, wherein the insert member is provided such that the projection has a shorter length and a smaller diameter than the body portion.

13. The method of claim 11, wherein the insert member is provided such that the insert member is composed of steel.

* * * * *